United States Patent [19]

Hayashi

[11] 3,960,567

[45] June 1, 1976

[54] PROCESS AND COMPOSITION FOR PRODUCING PHOTOLITHOGRAPHIC PLATE FOR THE GRAPHIC ARTS

[75] Inventor: Katsumi Hayashi, Minami-ashigara, Japan

[73] Assignee: Fuji Photo Film Co., Ltd., Minami-ashigara, Japan

[22] Filed: Oct. 7, 1974

[21] Appl. No.: 512,658

Related U.S. Application Data

[63] Continuation of Ser. No. 281,094, Aug. 16, 1972, abandoned.

[30] Foreign Application Priority Data

Aug. 21, 1971 Japan ..... 46-63928

[52] U.S. Cl. ..... 96/66.5; 96/66 R

[51] Int. Cl.[2] ..... G03C 5/30

[58] Field of Search ..... 96/66, 66 UP, 29 L, 96/66.3, 66.5

[56] References Cited

UNITED STATES PATENTS

| | | | |
|---|---|---|---|
| 2,784,086 | 3/1957 | Henn | 96/66 |
| 3,030,209 | 4/1962 | Henn | 96/66 |
| 3,265,501 | 8/1966 | Johnston | 96/61 M |
| 3,368,897 | 2/1968 | Burrows | 96/50 R |
| 3,615,437 | 10/1971 | Richardson et al. | 96/29 L |
| 3,639,124 | 2/1972 | Groncki | 96/29 L |

*Primary Examiner*—Mary F. Kelley

*Attorney, Agent, or Firm*—Sughrue, Rothwell, Mion, Zinn & Macpeak

[57] ABSTRACT

An infectious developer composition comprising (a) at least one of dihydroxybenzene derivative, (b) an antioxidant (c) an alkali agent and (d) a viscosity increasing agent is disclosed, a process for producing a photolithographic plate is also disclosed.

9 Claims, No Drawings

PROCESS AND COMPOSITION FOR PRODUCING PHOTOLITHOGRAPHIC PLATE FOR THE GRAPHIC ARTS

This is a continuation of application Ser. No. 281,094, filed Aug. 16, 1972, now abandoned.

BACKGROUND OF THE INVENTION

1. Field of the Invention

The present invention relates to a process for producing a photolithographic plate used for the graphic arts and, in more detail, to a litho-developer composition for producing a photolithograhic plate used for the graphic arts.

2. Description of the Prior Art

In order to produce a photolithographic plate used for the graphic arts, generally a litho-type photosensitive material for producing half-tone dots or line drawings or a high contrast photosensitive material by which images having very high contrast and excellent sharpness are formed have been used.

A half-tone printing plate can be produced by exposing a litho type photosensitive material to an image of the original through a contact screen and treating the material with a litho-developer composition.

It is preferable that the half-tone printing plate consist of dots having a maximum density and a background having a minimum density. However, areas having a intermedite density, the so-called fringe, are caused around the dots, because even the high contrast photosensitive material has an intermediate density. The fringe is not desirable for the graphic arts, because it causes a remarkable deterioration of the quality of the printing images. Namely, the quality of the half-tone dots is an important characteristic of a photolithographic plate used for the graphic arts.

The term litho-developer composition means an alkaline treating solution containing a known dihydroxybenzene type developing agent and an aldehyde-alkali hydrogen sulfite addition salt as a preservative (so-called infectious developer). Since a litho-developer composition of this kind includes a small amount of free sulfite ions so as to accomplish high contrast development, the stability of the developer composition is very inferior to that of the common monochromatic developer composition. Thus, an attempt for improving the stability by adding an antioxdant other than sulfite has been made. However, a developer composition having good stability as in the common monochromatic developer composition has not been obtained.

In order to treat the litho type photosensitive material, a plate development has been carried out widely hitherto. However, since plate development is complicated, a treatment using an automatic developing apparatus has been carried out recently. In treating using an automatic developing apparatus, the treating ability of the developer is kept uniform by adding a supplemental amount of the developer composition for every treatment of the photosensitive materials. However, it is necessary to adjust the quantity of the supplemental developer composition according to the size of the photosensitive material to be treated and the blackened area thereof. Where the developer composition is left as it is overnight in the plate of the automatic developing apparatus, it is necessary to add a large amount of the supplemental developer composition to recover the sensitivity thereof to the beginning level, because the stability of the developer composition is very inferior and the sensitivity deteriorates greatly. Accordingly, the treatment requires a long period of time, because the developer composition should be examined using a previously exposed control strip before treatment.

Although the sensitivity recovers due to the addition of the supplemental developer composition, the quality of the dots and the half-tone gradation related to the tone reproduction of the original do not return completely to the level obtained using the fresh developer composition.

Namely, it is impossible to retain a uniform treating ability. This tendency increases as the period of use increases. Further, if the litho-developer composition is left as it is for more than two days, the sensitivity and quality of half-tone dots do not recover at all even if a large amount of the supplemental developer composition is added, and, consequently, black spots appear. The above described situation is well known in the industry. Treatment of these photosensitive materials can be carried out only by a person who has a large amount of experience over a long period of time, and now much attention and time are required for controlling such a development.

Further, in such a treatment, materials dissolved from the photosensitive material and the oxidation products of the developer accumulate in the solution to cause the formation of scum and a deterioration of the treating ability.

Formation of half-tone dots by the litho-developer depends remarkably upon the degree of agitation of the developer composition. In general, dots of better quality can be obtained when the agitation is carried out gently. Accordingly, the quality of the dots obtained using an automatic developing apparatus is very different from that obtained using another automatic apparatus in which the character of the agitation is different. It is rarely the case that the intended quality of the photosensitive material results, because the litho-developer composition is very sensitive to pH and the developer composition has a different property each time it is prepared by the user. In actuality, even if a photosensitive material having the same quality is used, a variation results depending on the conditions and the method of treatment employed by the user.

As was described above, the prior process for treating the litho type photosensitive materials has many defects.

Accordingly, a first object of the present invention is to provide a treating process for producing a photolithographic plate used for the graphic arts which gives rise to half-tone dots having good quality.

A second object of the present invention is to provide a process for treating a litho type photosensitive material conveniently.

A third object of the present invention is to provide a treating process by which the many defects accompanying the treatment of the litho type photosensitive material by the lithodeveloper are removed and uniform properties are always obtainable.

Another object of the present invention is to provide an infectious developer composition for removing the above described defects.

SUMMARY OF THE INVENTION

As the result of many studies on attaining such objects, the present inventors have found that the above described multitude of problems are dissolved by developing a litho type photosensitive material using a viscous litho-developer composition to which an agent which increases the viscosity of the developer composition (hereinafter for brevity it will be designated as "viscosity increasing agent") is added.

Namely, a litho-developer composition containing a viscosity increasing agent is applied to a surface of an exposed photosensitive material at a specific thickness. After the conclusion of the development, the developer composition layer is removed. The material is then fixed in a fixer, rinsed and dried.

DETAILED DESCRIPTION OF THE INVENTION

Examples of the viscosity increasing agents which can be used in the present invention are carboxymethyl cellulose, hydroxyethyl cellulose, sodium alginate, methyl cellulose and water soluble polymers such as polyvinyl alcohol and copolymers of methylvinyl ether and maleic anhydride.

The viscosity increasing agent is added to the developer composition in the amount of from 0.1 to 5% by weight. Two or more viscosity increasing agents may be used together if desired. Viscosity of the developer composition is preferably from 1000 to 200,000 centipoises at 25°C. The developing treatment using a viscous treating solution is previously well known in the art. In actuality, use of viscous developer compositions for diffusion transfer treatment and developer compositions for specified uses such as air photographs and the monochromatic cinema films has been practically employed. However, treatment with a viscous litho-developer is not known.

The treatment of the present invention has a characteristic which has not seen in application of the known viscosity treatments in the viewpoint in that the complexities arising due to the peculiarities of the litho-development described above are dissolved.

The treating process of the present invention has the following characteristics.

1. The sensitivity, the quality of half-tone dots and the half-tone gradation are always uniform (they do not depend upon the number of sheets treated), since a fresh developer is always supplied to a surface of the photosensitive material.

2. The addition of a supplemental developer composition and the use of a control strip are not required.

3. There is no complexity as in the prior art, since it is not necessary to consider the fatigue and supplementing of the developer composition. Accordingly, it is not necessary to take the size of the photosensitive material to be treated and the blackened area thereof into consideration.

4. In the viscous developer, a rapidity of air oxidation is low in comparison with the nonviscous developer. Further, the poor stability characteristics of the litho-developer composition is not a disadvantage, because the viscous developer composition is preserved in an airtight container in order to prevent drying and oxidation and only a narrow nozzle part is exposed to the air at use.

5. The treating ability does not depend upon the users and a prearranged quality is always obtained, because the viscous developer composition is prepared by mixing and an automatic developing apparatus having different degree of agitation is not used.

6. The quality of the half-tone dots is remarkably improved, since the development using the viscous developer is substantially with no agitation.

7. In a case of using an automatic developing apparatus, the amount of the developer composition per sheet of the photosensitive material is large, because the volume of the liquid tank is large. However, according to the viscous development treatment, the amount of the developer composition is small and environmental pollution is not caused.

8. Anyone can do the treatment easily, because skilled operators are not necessary.

9. The viscous developer can be used without mixing each component of infectious developer and adding a replenisher of the components.

10. Trails (desensitization at the high density parts and sensitization at the low density parts) which occur in the treatment using an automatic developing apparatus do not occur in the viscous treatment.

The developer for viscosity development of the present invention is a conventional litho-developer composition. The litho-developer is a so-called infectious developer composition and the composition generally contains at least one of a dihydroxybenzene derivative such as hydroquinone as the developing agent; water soluble alkalis, acids and salts such as sodium carbonate, sodium hydroxide, acetic acid and boric acid as an alkali agent or a pH buffer agent; an aldehyde-alkali hydrogen sulfite addition product, a ketone-alkali hydrogen sulfite addition product as a sulfite ion buffer, a sulfite, ascorbic acid, or two or more thereof as an antioxidant; and an alkali metal halide as a development controlling agent.

An infectious developer composition as described above is basically composed of a dihydroxybenzene (developing agent), an alkali, a small amount of sulfite and, if necessary, a sulfite ion buffer. The infectious developer of the invention further contains the viscosity increasing agent.

Dihydroxybenzenes are known in the art and can be easily selected by one skilled in the art. Typical examples of these compounds are hydroquinone, chlorohydroquinone, bromohydroquinone, isopropylhydroquinone, toluhydroquinone, methylhydroquinone, 2, 3-dichlorohydroquinone, 2, 5-dimethylhydroquinone, etc. As a developing agent, hydroquinone can be practically used. These developing agents are used singly or in combination. A suitable amount of the developing agent to be added ranges from about 5 to 50g., preferably about 10 to 30g., per one liter of the developer.

A sulfite ion buffer can be used in such an amount that concentration of sulfite is maintained at a low level in the developer composition. Examples of such buffers are an aldehydealkali metal hydrogen sulfite addition product such as formalinsodium hydrogen sulfite, a ketone-alkali metal hydrogen sulfite addition product such as acetone-sodium hydrogen sulfite addition product, and a carbonylbisulfite-amine condensation product such as sodium bis(2-hydroxyethyl)aminomethane sulfonate. The sulfite ion buffer is not limited to the above examples and each ingredient of the addition product or condensation product may be added to the developer composition. The amount of the sulfite ion buffer which is added can range from about 13 to 130g., preferably 30 to 60g. per 1 liter of the developer.

An alkali is added to adjust the developer composition to an alkaline condition preferably to a pH higher than 8, more preferably to a pH of 9 to 11. Accordingly, the addition amount and kind of additive can be freely selected.

The developing composition can contain further a pH buffer agent, such as an alkanolamine, a water-soluble acid (e.g., acetic acid, boric acid), an alkali (e.g., sodium hydroxide) or a salt (e.g., sodium carbonate). Further, it may contain an alkali metal halide as a development controlling agent. Also, it may contain in some cases an organic anti-fogging agent (e.g., benzotriazole, 1-phenyl-5-mercapto-tetrazole), a polyalkylene oxide, an amine, and an organic solvent (e.g., triethylene glycol, dimethylformamide, methanol, cellosolve) in an amount of not more than 300 ml per 1 liter of the developer composition.

In the case of incorporating the sulfite addition salt described above, the addition salt may be formed by reacting in the liquid by adding each components separately to the developer composition.

As the photosensitive material for the graphic arts used in the present invention, common silver halide emulsions, for example, silver chloride emulsions, silver bromochloride emulsions and silver iodobromochloride emulsions can be used. But a silver bromochloride emulsion or silver iodobromochloride emulsion containing not less than 50mol% of silver chloride is preferably used. These photosensitive materials may contain hydrophilic colloidal substances as the dispersing agent for the silver halides, for example, gelatin, gelatin derivatives such as phthalic gelatin and malonic gelatin, cellulose derivatives such as hydroxyethyl cellulose and carboxymethyl cellulose, soluble starches such as dextrin and alkali starch, and hydrophilic high molecular substances such as polyvinyl alcohol, polyvinylpyrrolidone, polyacrylamides and polystyrene sulfonic acids. Further, these photosensitive materials may contain hydrophobic high molecular substances such as polyalkylacrylate, or may contain a gelatin plasticizer such as glycerin and trimethanol propane.

The emulsions to be used in these photosensitive materials may be sensitized by many methods at the production thereof or at the application thereof. For example, the emulsions may be sensitized chemically using well-known methods, for example, by sodium thiosulfate or alkyl thiourea, by gold compounds such as a complex salt of monovalent gold and thiocyanic acid, or mixtures thereof. Further, the emulsions may contain compounds of heavy metals such as platinum, palladium, iridium, rhodium and cadmium. The emulsions may be ortho- or panchromatically sensitized by adding a color sensitizing agents such as cyanine dyes and merocyanine dyes etc.

The emulsions may contain a half-tone improving agent such as polyalkylene oxides and amine compounds (U.S. Pat. No. 3,288,612, Germany patent specification O L S No. 1,932,882 and U.S. Pat. No. 3,345,175) and sodium benzene thiosulfate, benzotriazole or 1,3,3a,7-tetrazaindene derivatives (U.S. Pat. No. 3,375,114 or U.S. Pat. No. 3,333,959).

The emulsions may further be hardened using a hardening agent such as formaldehyde, resorcylaldehyde, dimethylol urea, 2,4-dichloro-6-hydroxy-1,3,5-triazine (U.S. Pat. No. 3,325,287) and mucochloric acid, or may contain a surface active agent such as saponin so as to facilitate the application of the emulsion. The emulsions may contain a development improving agent such as 3-pyrazolidone derivatives and may contain a development accelerator such as quaternary ammonium salts or cationic surface active agents.

As the support of the photosensitive materials used in the present invention, glass, cellulose acetate, polystyrene, polycarbonate, polyethylene terephthalate and resin coated paper etc. may be used.

In the following, the present invention will be explained in greater detail by reference to the following examples.

EXAMPLE 1

A silver halide emulsion comprising 75 mol% of silver chloride, 0.2 mol% of silver iodide and the balance of silver bromide was subjected to gold sensitization and sulfur sensitization. The emulsion was then chemically sensitized using 3-carboxymethyl-5[2-(3-ethylthiazolinylidene)ethylidene]rhodanindine. To the emulsion, polyoxyethylene containing 50 ethyleneoxide groups, nonylphenylether and a development accelerating agent described in Jap. Pat. Pub. No. 23465/65 were added.

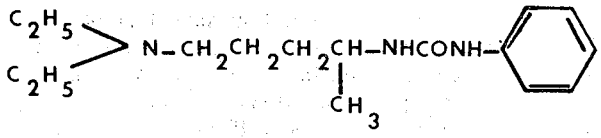

After adding further mucochloric acid and mixing then a polybutylmethacrylate polymer, the resulting mixture was applied to a film base to produce a litho film. This film was exposed to a wedge for sensitometry through a 150-line magenta contact screen, and treated with a viscous developer having the following composition.

| Developer composition A (preparation was carried out in a nitrogen atmosphere) | |
|---|---|
| Water | 500 cc |
| Formalin-Sodium Bisulfite Addition Product | 38 g |
| Hydroquinone | 23 g |
| Sodium Carbonate (monohydrate) | 80 g |
| Potassium Bromide | 1 g |
| Carboxymethyl Cellulose | 20 g |
| Water to make | 1 liter |

The above-described developer composition kept at 27°C was extruded using a hopper type coater onto a surface of the photosensitive element so as to apply a thickness of 150$\mu$. After 3 minutes, the layer of the developer was removed by a water flow. After the photosensitive element was fixed in a fixer for one minute, it was washed with water and dried.

For comparison, the above described photosensitive element was treated at 27°C for 3 minutes employing an automatic developing apparatus FG-14L (Fuji Photo Film Co. Ltd.) using a developer having the same composition of Developer composition A but not containing the carboxymethyl cellulose.

The treatment by the viscous developer not only had a characteristic that it was not necessary to be concerned with the fatigue of the developer composition and supplementing thereof as described above, but also the quality of the halftone dots was improved 1 grade as compared with treatment using the automatic developing apparatus. Furthermore, trails were not generated. Additionally, reproducible quality was obtained in comparison with that obtained using the automatic developing apparatus.

EXAMPLE 2

As the viscous developer, a mixture having the following composition was used.

| Developer composition B (preparation was carried out in a nitrogen atmosphere) | |
|---|---|
| Water | 500 cc |
| Sodium Sulfite (anhydrous salt) | 30 g |
| Paraformaldehyde | 7 g |
| Sodium Metabisulfite | 2.5 g |
| Boric Acid | 6.5 g |
| Hydroquinone | 22 g |
| Potassium Bromide | 1.5 g |
| Hydroxyethyl Cellulose (middle viscosity) | 8 g |
| Water to make | 1 liter |

Using the same photosensitive element as described in Example 1, a wedge for sensitometry was photographed through a 150-line magenta contact screen.

The Developer composition B kept at 27°C was dropped on a film support having the same width as the photosensitive element in which tapes having a thickness of 100$\mu$ were adhered on both sides thereof. The emulsion face of the exposed photosensitive element was then placed on the film support and was passed between a pair of press rolls. After 3 minutes, the photosensitive element was peeled off and the developer composition layer on the emulsion layer was removed using a shower of a stopping solution. After fixing for 3 hours it was washed with water and dried.

The half-tone dots thus obtained had no fringe and the size uniformity of the small dots was excellent.

EXAMPLE 3

As the viscous developer in this Example, a mixture having the following composition was used.

| Developer composition C (preparation is carried out in a nitrogen atmosphere) | |
|---|---|
| Water | 400 cc |
| Triethyleneglycol | 30 cc |
| Formalin-Sodium Bisulfite Addition Salt | 45 g |
| Sodium Sulfite | 1 g |
| Hydroquinone | 16 g |
| Sodium Carbonate (monohydrate) | 30 g |
| Sodium Hydroxide | 5 g |
| Boric Acid | 3 g |
| Potassium Bromide | 2 g |
| Ascorbic Acid | 0.5 g |
| Sodium Alginate | 5 g |
| Water to make | 1 liter |

The Developer composition C was placed in an airtight container. After leaving the composition at room temperature for 3 months, the photosensitive element was treated using the same procedure as described in Example 1. The treating ability of the developer composition was the same as that of the developer composition before storage.

While the invention has been described in detail and in terms of specific embodiments thereof, it will be apparent to one skilled in the art that various changes and modifications can be made therein without departing from the spirit and scope thereof.

What is claimed is:

1. In a process for producing a photolithographic plate for the graphic arts which comprises imagewise exposing and then developing a silver halide photographic material with an infectious developer composition having a pH higher than 8 and comprising (a) at least one member selected from the group consisting of hydroquinone and hydroquinone derivatives wherein said at least one member is the sole developing agent in said infectious developer composition, (b) an aldehyde-bisulfite addition product, (c) an alkai agent and (d) free sulfite ions, the improvement which comprises including a viscosity increasing agent selected from the group consisting of carboxymethyl cellulose, hydroxyethyl cellulose, sodium alginate, methyl cellulose, polyvinyl alcohol and methylvinyl ether-maleic anhydride copolymer; said developer composition having a viscosity of from about 1,000 to 200,000 centipoises at 25°C.

2. The process of claim 1, wherein said infectious developer composition further comprises (d) an antifogging agent.

3. The process of claim 1, wherein said silver halide photographic material comprises a suppot having thereon a silver halide emulsion layer containing more than 50 mol% of silver chloride.

4. The process of claim 1 wherein said viscosity increasing agent is present in said composition at a level of from 0.1 to 5% weight.

5. The process of claim 1, wherein said aldehyde-bisulfite addition product serves as a source of free sulfite ions and is present in an amount of from about 13 to 130 g. per liter of the infectious developer composition.

6. In an infectious developer composition for lithographic development having a pH higher than 8 and comprising (a) at least one member selected from the group consisting of hydroquinone and hydroquinone derivatives wherein said at least one member is the sole developing agent in said infectious developer composition, (b) an aldehyde-bisulfite addition product (c) an alkali agent and (d) free sulfite ions, the improvement which comprises including a viscosity increasing agent selected from the group consisting of carboxymethyl cellulose, hydroxyethyl cellulose, sodium alginate, methyl cellulose, polyvinyl alcohol and methylvinyl ethermaleic anhydride copolymer; said developer composition having a viscosity of from about 1,000 to 200,000 centipoises at 25°C.

7. The composition of claim 6, wherein said viscosity increasing agent is present in said composition at a level of from 0.1 to 5% by weight.

8. The composition of claim 6 further comprising an aldehyde bisulfite-addition product.

9. The composition of claim 8, wherein said aldehydebisulfite addition product is a source of free sulfite ions in said composition, and said aldehyde-bisulfite addition product is present in an amount of from about 13 to 130 g./liter of said composition.

* * * * *